US008132860B2

(12) United States Patent
Fookes et al.

(10) Patent No.: US 8,132,860 B2
(45) Date of Patent: Mar. 13, 2012

(54) ARMREST FOR A CHAIR

(75) Inventors: Tim Fookes, Hudsonville, MI (US); Joe Willette, Grand Haven, MI (US); Steve Simpson, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 12/925,888

(22) Filed: Nov. 1, 2010

(65) Prior Publication Data

US 2011/0140497 A1 Jun. 16, 2011

Related U.S. Application Data

(63) Continuation of application No. PCT/US2009/002728, filed on May 1, 2009.

(60) Provisional application No. 61/126,321, filed on May 2, 2008.

(51) Int. Cl.
*A47C 7/54* (2006.01)

(52) U.S. Cl. ..... 297/411.2; 297/411.26

(58) Field of Classification Search ..... 297/411.2, 297/411.26, 411.43, 411.44, 411.45; 403/361, 403/383

See application file for complete search history.

(56) References Cited

U.S. PATENT DOCUMENTS

| | | | | |
|---|---|---|---|---|
| 2,021,242 | A | 11/1935 | Reyniers | |
| 2,966,208 | A | 12/1960 | Good | |
| 3,129,472 | A * | 4/1964 | Hensel | 403/7 |
| 3,982,785 | A * | 9/1976 | Ambasz | 297/160 |
| 4,327,461 | A * | 5/1982 | Wisniewski | 16/42 R |
| 5,356,237 | A * | 10/1994 | Sung | 403/374.3 |
| 5,382,080 | A * | 1/1995 | Gamberini et al. | 297/440.1 |
| 5,599,067 | A | 2/1997 | Schuelke et al. | |
| 5,647,638 | A | 7/1997 | Ritt et al. | |
| 5,746,479 | A | 5/1998 | Bodnar | |
| 5,853,223 | A | 12/1998 | Ritt et al. | |
| 6,053,579 | A | 4/2000 | Nelson et al. | |
| 6,073,997 | A * | 6/2000 | Koh | 297/173 |
| 6,427,289 | B2 * | 8/2002 | Flanz | 16/433 |
| D475,211 | S * | 6/2003 | Neil | D6/374 |
| 6,899,396 | B2 * | 5/2005 | Bales | 297/446.2 |
| 6,976,739 | B2 | 12/2005 | Wang | |
| 2009/0079235 | A1 * | 3/2009 | Huang | 297/42 |
| 2009/0212607 | A1 * | 8/2009 | Kaloustian et al. | 297/188.21 |

FOREIGN PATENT DOCUMENTS

| | | |
|---|---|---|
| DE | 89 06 990 U1 | 7/1989 |
| GB | 2 219 496 A | 12/1989 |

OTHER PUBLICATIONS

International Search Report for corresponding PCT Application No. PCT/US2009/002728.

International Preliminary Report on Patentability for corresponding PCT Application No. PCT/US2009/002728.

* cited by examiner

*Primary Examiner* — David Dunn
*Assistant Examiner* — Philip Gabler
(74) *Attorney, Agent, or Firm* — Flynn, Thiel, Boutell & Tanis, P.C.

(57) ABSTRACT

An armrest for a chair is provided which has an improved anti-rotation and mechanical connection between an armrest body and a frame tube of the chair. The end of the frame tube is mechanically deformed or is shaped so as to have a non-circular profile with a central opening defined by inwardly projecting arcuate surfaces of the frame tube. The armrest includes a cooperating, non-circular socket which fits onto the frame tube wherein a suitable fastener is threaded downwardly into direct, self-threading engagement with an upper opening formed in the end of the frame tube.

24 Claims, 5 Drawing Sheets

ARMREST FOR A CHAIR

CROSS REFERENCE TO RELATED APPLICATION

This application is a continuation of International Application No. PCT/US2009/002728, filed May 1, 2009, which claims the benefit of U.S. Provisional Application Ser. No. 61/126,321, filed May 2, 2008, which is incorporated herein by reference in its entirety.

FIELD OF THE INVENTION

The invention relates to an improved armrest for a chair, and more particularly, to an armrest having an improved connection to a frame tube of a tubular chair frame.

BACKGROUND OF THE INVENTION

Chairs have been developed having many different designs and constructions. One type of chair uses tubular frame tubing to construct a chair frame. The frame tubing may have upwardly projecting columns which each define a post to which an armrest is mounted. An example of such a chair is U.S. Pat. No. 5,746,479.

It is an object of the invention to provide an improved armrest and in particular, an improved connection between an armrest and a frame tube which defines an anti-rotation connection between the armrest and frame tube and also lockingly engages these components together.

The invention thereby relates to an armrest for a chair wherein the chair is provided with upwardly projecting tubular uprights that are disposed on opposite leftward and rightward sides of a seat. The frame tubes which define the post have a tubular shape with a uniform circular cross-section along the major length thereof. At the upper ends of the frame tube, however, the upper end is shaped and in particular, preferably is swaged, so that the terminal upper end of the frame tube has a non-circular shape.

The frame tube is of a conventional metal tubular construction wherein the shaping or swaging operation results in a shape which facilitates the mechanical connection of the armrest to the frame tube. This non-circular shape is defined by the outer exterior surface of the frame tube, and preferably as a four-lobed shape wherein individual lobes are separated one from the other by channel-like recesses.

The swaged shape of the frame tube also defines a central bore which opens upwardly and is adapted to threadedly receive a downwardly projecting fastener which projects through the armrest and mechanically fastens the armrest to the frame tube. In this regard, the recesses of the swaged tube end have interior surfaces which are arcuate and each define an apex wherein the apexes of each recess are located in four quadrants and provide interior surfaces to which the threads of the fastener can bite or engage. These apexes do not require threading during the manufacturing process but are threaded by a self-tapping screw which is used as the fastener.

As to the armrest, the armrest includes a downward-opening collar which defines a downward-opening socket into which the upper tube end is received. The socket has a non-circular configuration which generally conforms to the swaged tube end so that when the socket is slid onto the tube end, the armrest is prevented from rotating. Further, the innermost end wall defining the bottom of the socket has a fastener bore projecting vertically therethrough in co-axial alignment with the socket and which is adapted to receive the fastener downwardly therethrough. This fastener bore is aligned with the central opening of the tube end wherein the armrest is secured in position by threading the fastener down into the swaged tube end.

This provides a relatively simple connector structure for the armrest and chair frame and allows for easy assembly since the frame tube does not require any additional structures to be added thereto.

Other objects and purposes of the invention, and variations thereof, will be apparent upon reading the following specification and inspecting the accompanying drawings.

Figure 1:
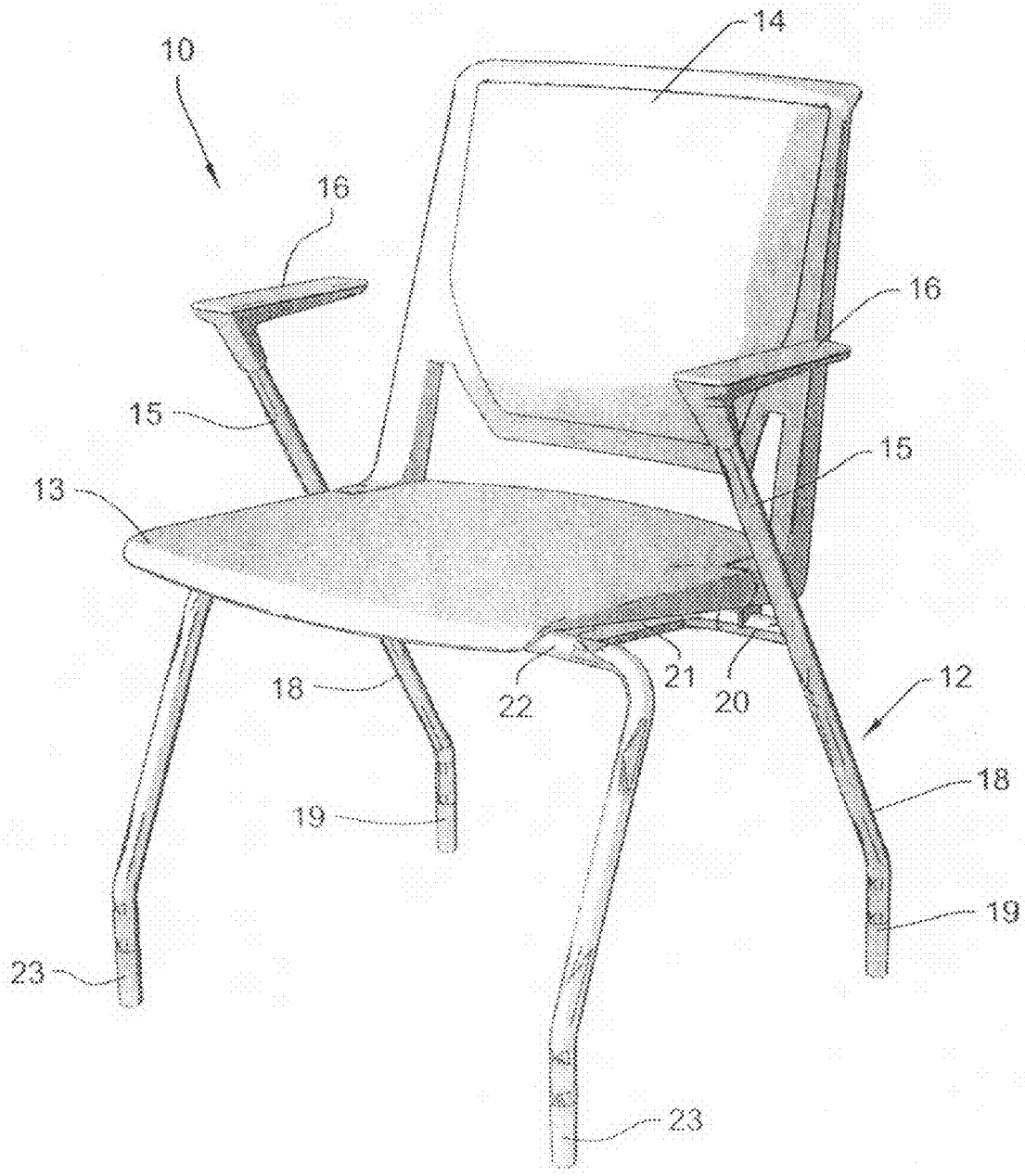
FIG. 1 is a perspective view of a chair comprising an armrest of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the chair 10 of the invention is depicted which includes a chair frame 12 that supports a seat 13 and back 14 thereon for supporting the respective seat and back of a chair occupant. The chair frame 12 includes upwardly projecting posts 15 disposed on opposite sides of the seat 13 for supporting respective arm rest assemblies 16 thereon. The arm rest assemblies 16 and cooperating posts 15 each include an improved inventive connector arrangement therebetween which defines an anti-rotational engagement and a mechanical connection as will be described further herein.

Turning first to the posts 15 as defined on the chair 10, each post 15 in the preferred embodiment comprises the upper terminal end 17 of a frame tube 18. The frame tube 18 in the illustrated embodiment of FIG. 1 comprises a vertically elongate member that has the majority of the lower portion thereof defining a rear chair leg 19. These rear frame tubes 18 are joined laterally by a transverse frame tube 20 and forwardly, by additional tubes 21, to an additional front frame tube 22 that curves downwardly and defines the front chair legs 23. These various tubes which form the chair frame 12 typically have a circular cross-section and form a tubular type of chair frame which may be desirable due to the ease of use of such tubular frame members and joining thereof. It will be understood that the inventive connector arrangement may be adapted to other types of chair frame constructions.

As to the rear frame tubes 18, these tubes 18 each extend upwardly above the seat 13 and terminate at an upper tube end 17 to thereby serve as a post or column 15 for a respective arm rest assembly 16.

While the invention in the preferred embodiment is applied to a tubular type frame construction, it will also be understood that the posts 15 may themselves only extend downwardly to the seat and have lower ends which join directly to additional frame structure. As such, the invention does not necessarily require that the posts 15 be formed as integral upward extensions of the rear frame tubes 18.

Figure 2:
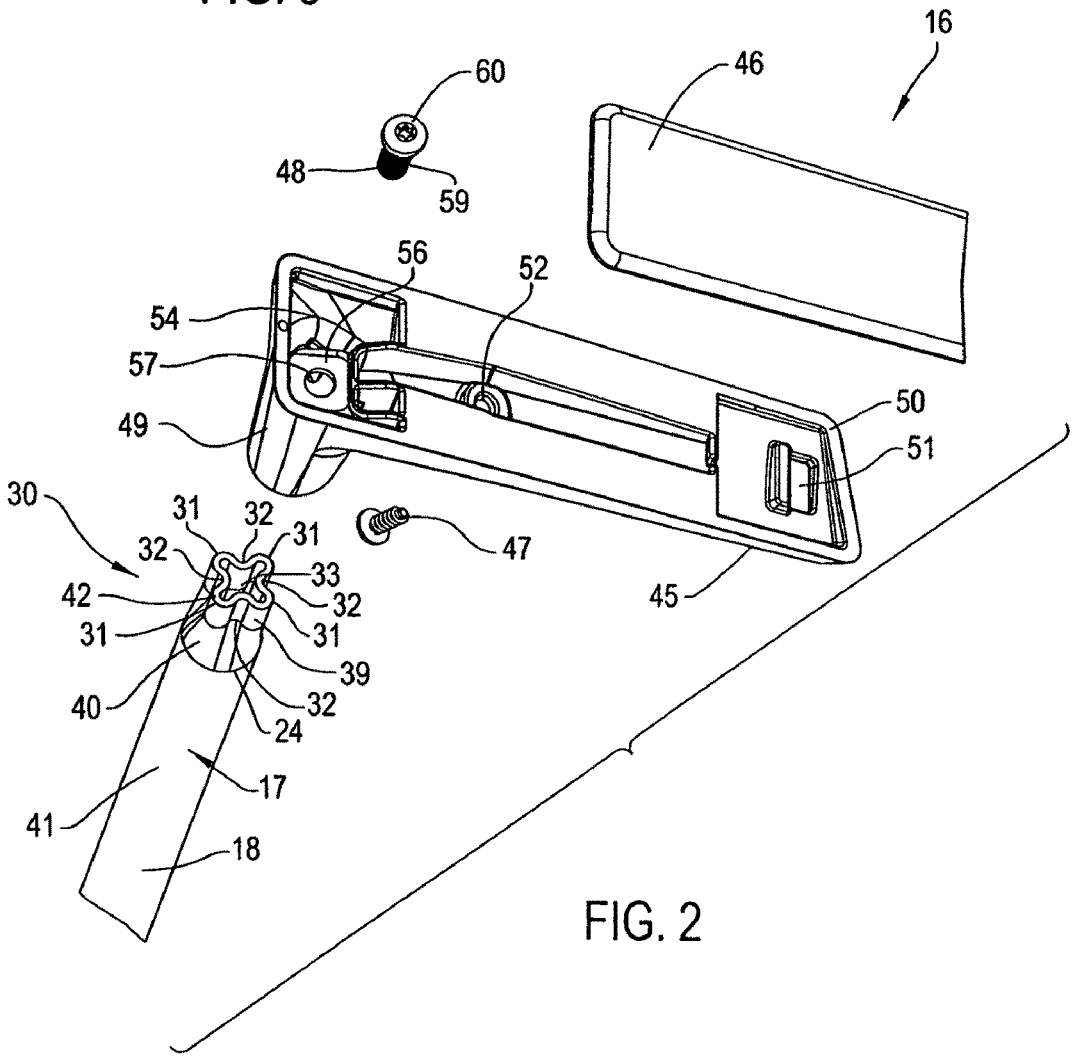
FIG. 2 is an exploded perspective view of an armrest assembly being mounted on a frame tube of the chair.
Figure 4:
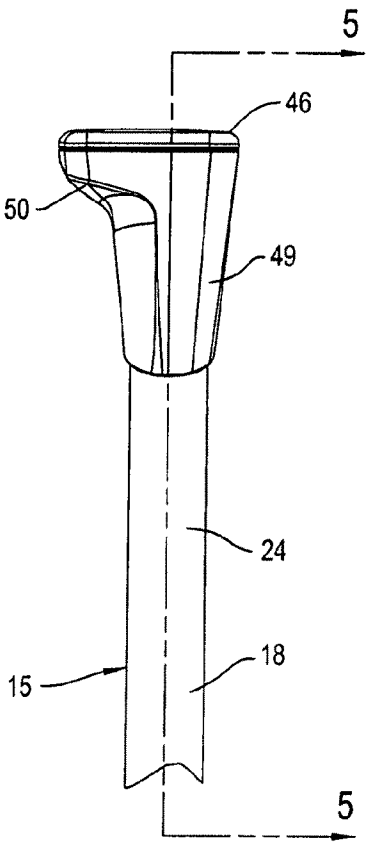
FIG. 4 is a front view of the armrest.
Figure 3:
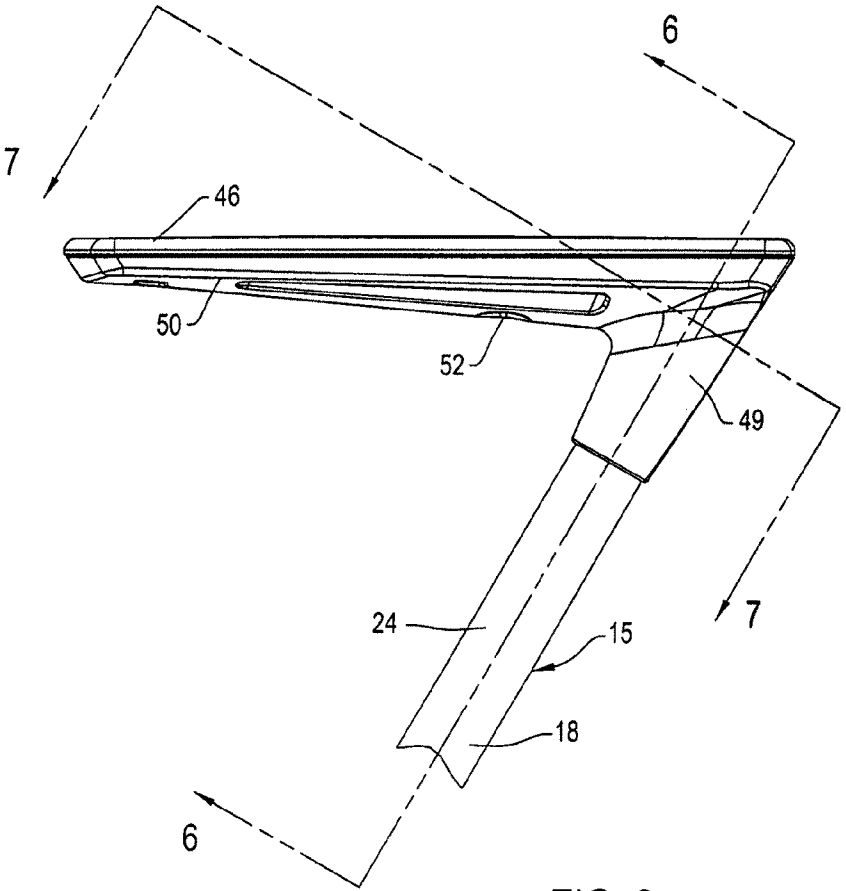
FIG. 3 is a left side elevational view of the armrest.
Figure 7:
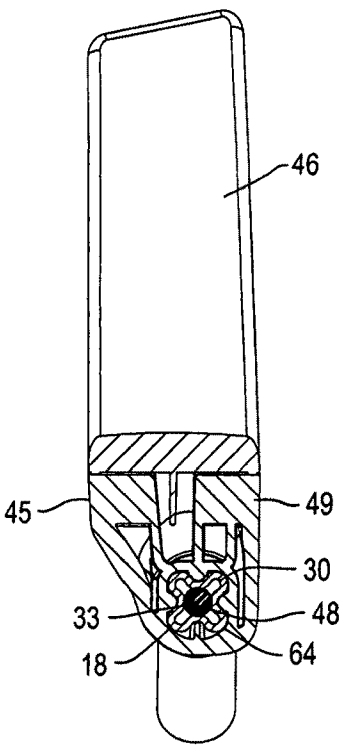
FIG. 7 is a top cross-sectional view as taken along line 7-7 of FIG. 3.
Figure 5:
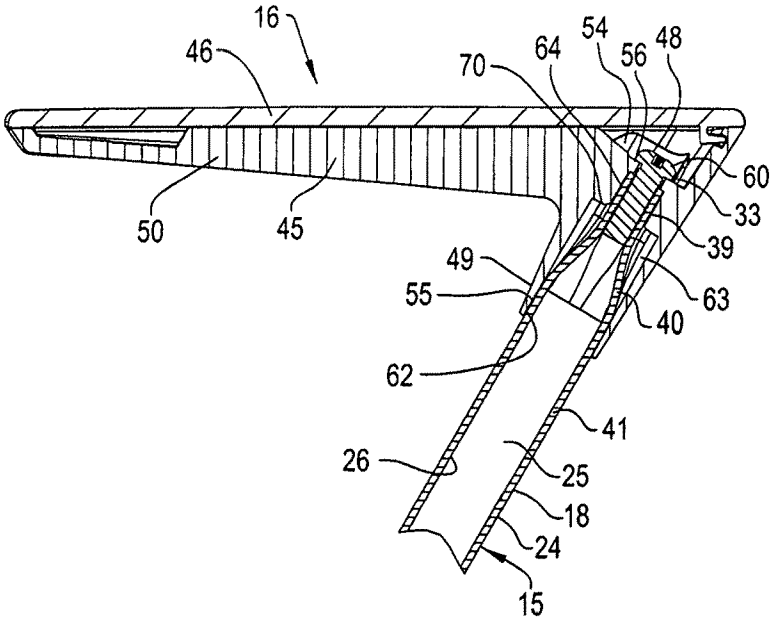
FIG. 5 is a side cross-sectional view as taken along line 5-5 of FIG. 4.

Referring to FIGS. 2-4, the frame tube 18 preferably is formed of rigid metallic tubing having a circular cross-sectional shape defined exteriorly by an outer circumferential surface 24. As seen in FIG. 5, the frame tube 18 has a hollow interior 25 that is bounded by and defined interiorly by an interior tube surface 26.

Preferably, these tube surfaces 24 and 26 have concentric, circular cross-sectional shapes when viewed from the end thereof so that the frame tube 18 has a uniform, circular cross-section at least proximate the upper tube end 17.

To provide for the connection of the arm rest assembly 16 to the frame tube 18, the upper tube end 24 is shaped or deformed so as to have a non-circular profile which serves multiple functions. In this regard, the non-circular profile is used to prevent relative rotation of the mounted armrest assembly 16, and also provides for fastening of the armrest assembly 16 downwardly onto the frame tube 18 to define a mechanical connection therebetween. The following discussion describes such functions in additional detail.

More particularly, the upper tube end 17 is reshaped so as to define a non-circular armrest mount 30 which extends vertically as an extension of the main tube section. Preferably, the mount 30 is formed by swaging or in other manner deforming the distal free end of the frame tube 18 so as to have the non-circular shape illustrated in FIGS. 2 and 9. Generally, the preferred shape of the armrest mount 30 is a generally X-shaped configuration defined by four lobes 31 separated from each other by recesses or channels 32. These recesses 32 curve inwardly and therefore define a narrowed, central opening 33, the structure and function of which is described in further detail hereinafter.

Figure 9:
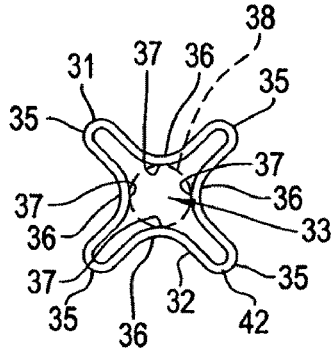
FIG. 9 is an enlarged top view of the swaged end portion of the frame tube.

Referring more particularly to FIG. 9, the separate lobes 31 are defined by outwardly curved surfaces 35 which are generally arcuate in the preferred embodiment. The recesses 32 are exteriorly defined by inwardly curved arcuate surfaces 36. These recess surfaces 36 are located exteriorly, and on the interior thereof curve inwardly to an apex 37. Each of these apexes 37 is located on the circumference of a common reference circle 38 (shown in phantom outline) and essentially define the maximum diametral width of the central opening 33.

As will be described further hereinafter, the apexes 37 define four sections of the frame tube 18 that are available for threaded engagement to secure the armrest assembly 16 to the frame tube 18.

Referring to FIG. 2, the swaged armrest mount 30 preferably comprises a uniform cross-sectional section 39 at the outer distal end thereof which is joined to the undeformed section of the frame tube 18 by a tapered transition section 40. As such, the maximum diametral dimension of the uniform tube section 39 is less than the maximum diametral dimension of the undeformed tube section 41 wherein the transition section 40 slopes radially inwardly from the undeformed section 41 to the uniform section 39.

Figure 6:
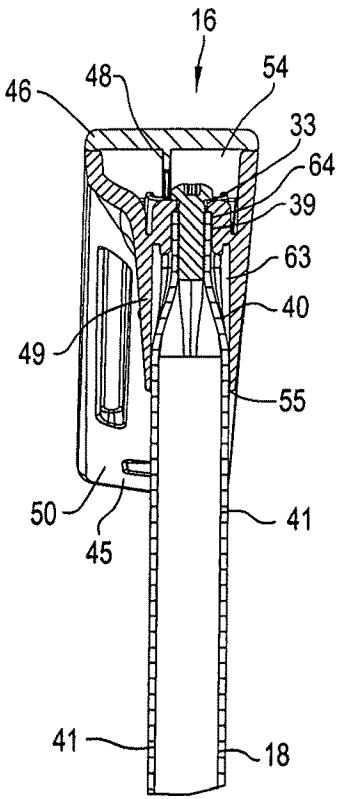
FIG. 6 is an end cross-sectional view of the armrest as taken along line 6-6 of FIG. 3.

These subsections of the frame tube 18 are illustrated in more detail in FIGS. 5 and 6 which shows the frame tube 18 supporting the armrest assembly 16 thereon. FIGS. 2 and 9 also show the tube end face 42.

Referring to the arm assembly 16 as illustrated in FIGS. 2-4, the arm assembly 16 comprises an armrest body 45, an arm cap 46, and a fastener 47 which joins the armrest body 45 and arm cap 46 together as will be described in further detail herein. Further, the armrest assembly 16 also includes the fastener 48 (FIG. 2) which is used to fixedly attach the armrest body 45 to the frame tube 18.

Generally, the armrest body 45 (FIGS. 2-4) has a mounting hub 49 which supports a cantilevered support arm 50 projecting forwardly therefrom. The front end of the support arm 50 includes a connector 51 to which the front end of the arm cap 46 is preliminarily attached. Rearwardly of the connector 51, the support arm 50 includes a fastener hole 52 which aligns with a corresponding fastener bore in the arm cap 46 such that the aforementioned fastener 47 can be inserted upwardly through the hole 52 and threadedly engaged with the arm cap 46 to removably secure the arm cap 46 in an overlying position on top of the support arm 50.

Referring to FIGS. 2 and 5, the mounting hub 49 has an upward opening chamber 54, a downward opening socket 55 and an intermediate wall 56 which separates the chamber 54 from the socket 55. The socket 55 generally is similar to a blind bore wherein the dividing wall 56 would serve as the end wall of such bore. The socket 55 is configured so as to receive the armrest mount 30 of the frame tube 18 upwardly therein for defining a secure connection between the armrest body 45 and the frame tube 18.

The dividing wall 56 further includes a fastener hole 57 opening vertically therethrough which is adapted to receive the threaded shank 59 of the fastener 48 downwardly into engagement with the frame tube 18 while the fastener head 60 secures itself or abuts downwardly against the opposing dividing wall 56. The chamber 54 therefore is sufficiently large so as to accommodate the fastener head 60 therein, which chamber 54 then is enclosed once the arm cap 46 is mounted to the armrest body 45.

More particularly as to the cooperation of the socket 55 and the armrest mount 30, the bottommost portion of the socket 55 has a circular opening 62 which corresponds to the circumference of the undeformed tube section 41 so as to lie in close facing relation therewith.

The circular opening 62 continues into a mouth portion 63 of the socket 55 which has a uniform diameter along the vertical length thereof.

At the uppermost end of the socket 55, a seat portion 64 is formed which defines a non-circular pocket that snugly fits or seats the armrest mount 30 of the frame tube 18 therein. This seat portion 64 is located directly adjacent to the wall 56 with the fastener hole 57 opening therein so that the fastener 48 (FIGS. 5 and 6) can be threaded downwardly through the hole 57 into threaded engagement with the central opening 33 of the armrest mount 30. Generally, the non-circular, corresponding shapes of the armrest mount 30 and the seat portion 64 prevent rotation of the armrest body 45, while the wall opening 57 and the engagement of the fastener 48 forms a mechanical connection between the armrest body 45 and the frame tube 18.

Figure 8:
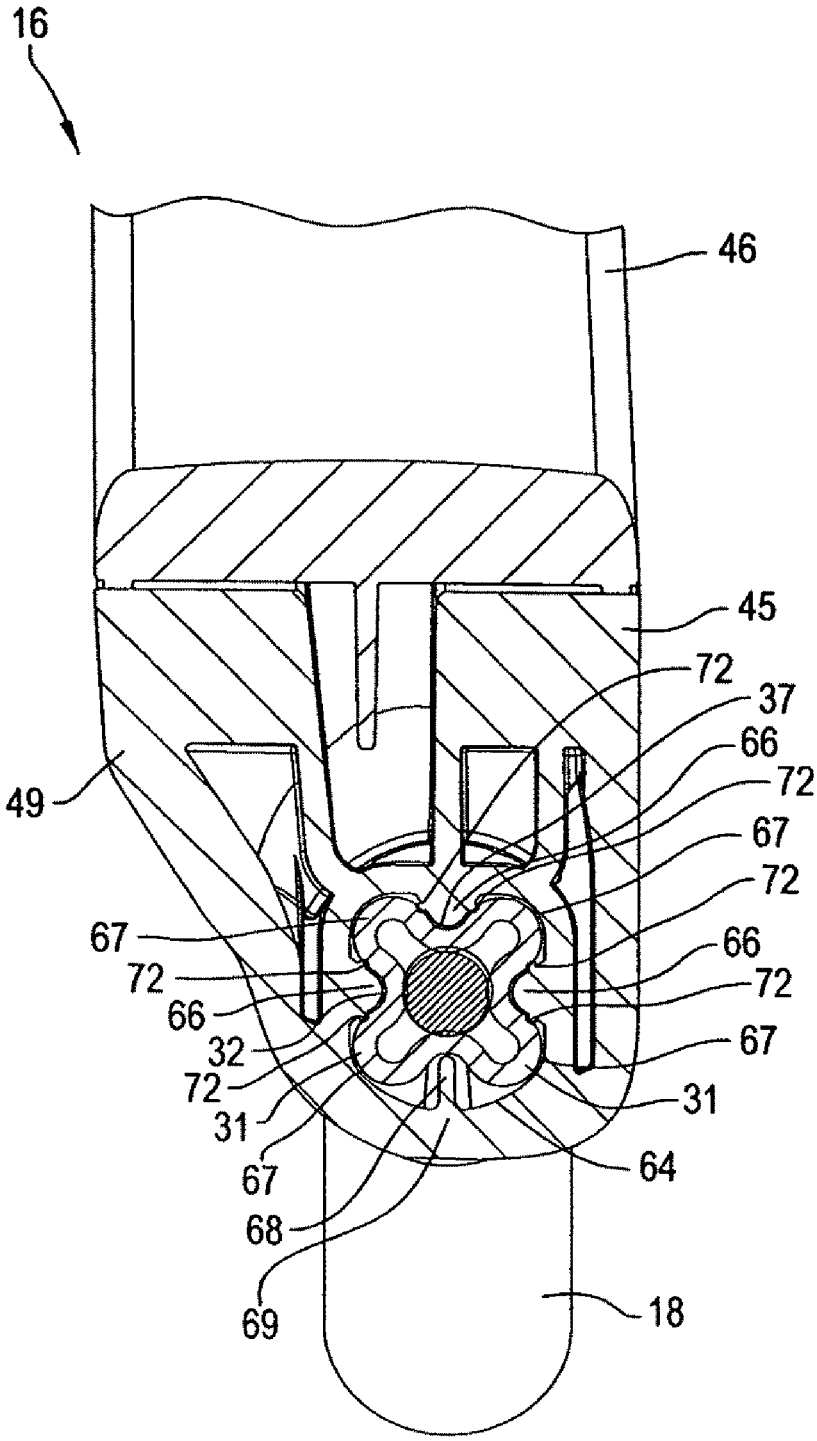
FIG. 8 is an enlarged cross-sectional view of the connection between an armrest and frame tube.

As to the structure of the seat portion 64, FIG. 8 illustrates an enlarged view thereof. This seat portion 64 has the aforementioned non-circular shape which is defined by three ribs 66 which project radially inwardly and align with three of the recesses 32 that are defined between the lobes 31 of the mount 30 when seated in place. These ribs 66 essentially define corner grooves 67, which grooves 67 are configured to align with and receive the aforementioned lobes 31. The opposed surfaces of these ribs and grooves 66 and 67, and the lobes and recesses 31 and 32 are disposed closely adjacent to each other as generally seen in FIG. 8. These ribs 66 are located in three of the quadrants of the socket seat portion 64 while the fourth quadrant thereof differs somewhat in that it includes a substantially narrower flange 68 which projects inwardly into the fourth one of the mount recesses 32. While the flange 68 might be replaced with a rib 66 having the same shape as the other ribs 66, the narrower flange 68 has a different shape to facilitate molding of the plastic material forming the armrest body 45. In effect, the flange 68 prevents sink after molding of the hub wall 69.

At the bottommost edge of the seat portion 64, it is desirable to also provide a chamfer 70 (FIG. 5) which facilitates alignment of the mount 30 with the seat portion 64 during insertion of the frame tube into the opening 62 of the socket 55.

To provide snug fitting, contacting cooperation between the opposed surfaces of the shaped armrest mount 30 and the correspondingly shaped seat portion 64, each of the ribs 66 include a pair of narrow ridges 72 which are in direct contact with the lobes 31 of the mount 30 to prevent or at least minimize play between the armrest body 45 and the frame tube 18. These ridges 72 are thin and relatively small wherein the ridges 72 may be oversized somewhat so that insertion of the mount 30 effects scraping or removal of some of the ridge material so that it is assured that there is direct contact between each of the ridges 72 and an opposing surface of the lobes 31. In this regard, the tube end face 42 may thereby contact the terminal ends of the ridges 72 and effects scraping of some of this ridge material.

Once the armrest body 45 is seated downwardly onto the armrest mount 30, the tube end face 42 bottoms out against the end wall 56. In this fully seated position, the hole 57 in the socket wall 56 is now aligned coaxially with the central opening 33 of the mount 30 to permit threading of the fastener 48 downwardly therethrough.

It is noted that the outer circumference of the threaded shank 59 of this fastener 48 is greater than the diameter of the central opening 33 that is indicated by the reference circle 38 (FIG. 9). As previously described, the interior apexes 37 are located on this reference circle 38, and since the diameter of the threaded shank 59 extends radially outwardly of the positions of the apexes 37, there is an interference between the fastener shank 59 and the apexes 37. Despite the interference, the threads on the shank 59 are self-threading so that as the fastener 48 is rotated i.e. threaded downwardly, the threads thereof cut into the apexes 37 to define or form mating threads in the mount 30. As such, the shank threads cut or bite into the apexes 37 so as to essentially define a threaded opening formed by the central opening 33.

With the fastener 48 threaded into engagement with the mount 30, the armrest body 45 is now fixedly secured to the armrest mount 30, with the cooperating ribs 66 and recesses 32 serving to prevent relative rotation of the armrest body 45 relative to the frame tube 18. It is also believed that the interference between the fastener shank 59 and the armrest mount 30 could displace the recessed sections of the armrest mount 30 radially outwardly which could increase the contact pressure between the mount 30 and the ridges 72 on the socket ribs 66. This gripping cooperation, where such occurs, would further enhance the mechanical connection between the armrest body 45 and frame tube 18 to complement the threaded engagement of the fastener 48 to the mount 30.

Due to the foregoing, the above-described structure provides an improved armrest connection for a chair. In particular, the aforementioned inventive design provides advantages in that the frame tube 18 formed of a common circular profile may simply be deformed at the distal end thereof to define the armrest mount 30. The deformation which forms the armrest mount 30 serves both an anti-rotation function and a mechanical connection function without the requirement for any additional component parts being provided on the armrest mount 30. The only additional components required are those components of the armrest assembly 16 including the fastener 48 which cuts its own threads into the interior tube surface 26 in the region of the recesses 32.

Hence, once the frame tube 18 is properly shaped, assembly of the chairs is accomplished by inserting the upper end of the frame tube 18 upwardly into the corresponding socket 55 of the armrest body 45. Since a tight fit is formed therebetween, the assembly process may involve forceful downward driving of the armrest body 45 which preferably affects some level of material removal from the ridges 72 as such are scraped by the tube end face 42. This thereby provides a tight connection with minimal play therebetween. Due to the cooperating, non-circular profiles of the mount 30 and the socket 55, and in particular, the seat portion 64 of the socket 55, the armrest body 45 is prevented from rotating merely by seating of the body 45 on the mount 30. With the top cap 46 removed, the fastener 48 is then threaded downwardly. Upon the first installation of the fastener 48, the threaded shank 59 cuts appropriate threads into the apexes 37 of the end section 39 of the frame tube 18. Thereafter, the arm cap 46 is mounted to the armrest body 45 as described previously herein to cover the fastener 48.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An armrest construction for a chair, comprising:

a support post having an elongate main section along a major length thereof and an armrest mount defined at a free end of said main section, said free end being hollow so as to define a peripheral interior post surface and being shaped to define a non-circular outer peripheral profile when viewed from said free end which said profile is defined by a plurality of peripherally spaced lobes separated from each other by elongate channels, said interior post surface defining a central opening which opens end-wise from said free end; and an armrest assembly comprising an armrest body mountable to said armrest mount of said post, said armrest body comprising a hub mountable to said armrest mount and a support arm positioned to support a chair occupant, said hub defining an open socket which comprises a seat which receives said armrest mount therein, said seat being defined at an inner end by a socket end wall and having a non-circular inner peripheral profile defined by a plurality of ribs spaced apart by grooves which said ribs and grooves respectively conform to and mate with said channels and lobes of said armrest mount to non-rotatably position said hub relative to said armrest mount, said armrest assembly further including a fastener which projects through said socket end wall and fixedly engages said central opening of said armrest mount to fixedly secure and prevent removal of said armrest body from said post.

2. The armrest construction according to claim 1, wherein said fastener has a shank with an outer diameter greater than an inner diameter of said central opening to deform said interior post surface.

3. The armrest construction according to claim 2, wherein said interior post surface is unthreaded and said fastener is a self-tapping fastener which bites into said interior post surface.

4. The armrest construction according to claim 3, wherein said post is a tube having a circular thin-walled profile along said main section, wherein said armrest mount is formed by reshaping said tube to form said non-circular outer peripheral profile, said channels of said armrest mount defining apexes on said interior post surface, and said apexes lie on a circle which defines said central opening.

5. The armrest construction according to claim 1, wherein said post is a tube having a circular thin-walled profile along said main section, wherein said armrest mount is formed by reshaping said tube to form said non-circular outer peripheral profile, said channels of said armrest mount defining apexes on said interior post surface, and said apexes lie on a circle which defines said central opening.

6. The armrest construction according to claim 5, wherein said post is defined by a tubular frame of a chair.

7. The armrest construction according to claim 1, wherein said socket end wall includes a fastener bore formed therethrough in alignment with said central opening, and said armrest body includes a chamber defined on a side of said socket end wall opposite said socket so that said fastener bore opens into said chamber, said chamber receiving said fastener therein with a shank of said fastener projecting through said fastener bore into threaded engagement with said central opening of said armrest mount.

8. The armrest construction according to claim 7, wherein said armrest assembly comprises a cap which is removably engaged with said armrest body to enclose said fastener within said chamber.

9. An armrest construction for a chair, comprising:

a tubular support post having an elongate main section along a major length thereof wherein said main section has a circular thin-walled profile defined by inner and outer tube surfaces of a tube, said support post further having an armrest mount defined at a free end of said main section, said armrest mount being formed by reshaping said circular thin-walled profile of said tube said free end to provide said armrest mount with a non-circular outer peripheral profile defined by said outer tube surface, said free end being hollow so as to define a peripheral interior post surface defined by said inner tube surface which is unthreaded, said interior post surface defining a plurality of peripherally spaced and inwardly projecting apexes which lie on a circle which defines a central opening which opens end-wise of said free end; and an armrest assembly comprising an armrest body mountable to said armrest mount of said post, said armrest body comprising a hub mountable to said armrest mount and a support arm positioned to support a chair occupant, said hub defining an open socket which comprises a seat which receives said armrest mount therein, said seat being defined at an inner end by a socket end wall and having a non-circular inner peripheral profile which conforms to and mates with said non-circular outer peripheral profile defined by said outer tube surface of said armrest mount to non-rotatably position said hub relative to said armrest mount, said armrest assembly further comprising a fastener projecting through said socket end wall and fixedly engaging said central opening of said armrest mount to fixedly secure and prevent removal of said armrest body from said post, said fastener having a shank which bites into said unthreaded interior post surface at said apexes for fixed engagement therewith.

10. The armrest construction according to claim 9, wherein said outer peripheral profile of said armrest mount is defined by a plurality of peripherally spaced lobes separated from each other by elongate channels, wherein said channels of said armrest mount define said apexes on said interior post surface.

11. The armrest construction according to claim 10, wherein said non-circular inner peripheral profile of said socket is defined by a plurality of ribs spaced apart by grooves which said ribs and grooves respectively conform to and mate with said channels and lobes of said armrest mount.

12. The armrest construction according to claim 9, wherein said fastener is a self-tapping fastener which bites into said interior post surface at said apexes.

13. The armrest construction according to claim 12, wherein said socket end wall includes a fastener bore formed therethrough in alignment with said central opening, and said armrest body includes a chamber defined on a side of said socket end wall opposite said socket so that said fastener bore opens into said chamber, said chamber receiving said fastener therein with a shank of said fastener projecting through said fastener bore into threaded engagement with said central opening of said armrest mount.

14. The armrest construction according to claim 9, wherein said post is swaged at said free end to form said armrest mount.

15. The armrest construction according to claim 14, wherein said post comprises a tapered section joining said main section to said armrest mount which tapers radially inwardly from said circular thin-walled profile to said non-circular outer peripheral profile.

16. The armrest construction according to claim 14, wherein said outer peripheral profile of said armrest mount is defined by a plurality of peripherally spaced lobes separated from each other by elongate channels, wherein said channels of said armrest mount define said apexes on said interior post surface, said lobes and said channels being formed by said post being swaged.

17. An armrest construction for a chair, comprising:

a support post having an elongate main section along a major length thereof and an armrest mount defined at a free end of said main section, said post being a thin-walled tube and said free end being hollow so as to define a peripheral interior post surface, said free end being shaped to define a non-circular outer peripheral profile when viewed from said free end which said profile is defined by a plurality of peripherally spaced lobes separated from each other by elongate channels, said interior post surface defining a central opening which opens end-wise from said free end and said free end has an end face which defines an outer peripheral edge; and an armrest assembly comprising an armrest body mountable to said armrest mount of said post, said armrest body comprising a hub mountable to said armrest mount and a support arm positioned to support a chair occupant, said hub defining an open socket which comprises a seat which receives said armrest mount therein, said seat being defined at an inner end by a socket end wall and having a non-circular inner peripheral profile defined by a plurality of ribs spaced apart by grooves which said ribs and grooves respectively conform to and mate with said channels and lobes of said armrest mount to non-rotatably position said hub relative to said armrest mount, said inner peripheral profile of said socket being defined by an interior surface which said interior surface includes thin ridges projecting therefrom, said ridges interfering with said peripheral edge of said post such that said peripheral edge effects removal of portions of said ridges upon insertion of said armrest mount into said socket to provide a tight-fitting engagement therebetween.

18. The armrest construction according to claim 17, further including a fastener which projects through said socket end wall and fixedly engages said central opening of said armrest mount to fixedly secure and prevent removal of said armrest body from said post.

19. The armrest construction according to claim 17, wherein said peripheral edge defines a sharp corner and said removal of said portions of said ribs is effected by scraping.

20. The armrest construction according to claim 19, wherein said post is defined by a metal frame tube of a chair.

21. The armrest construction according to claim 1, wherein said channels of said armrest mount define respective apexes on said interior post surface, said apexes together defining said central opening and fixedly engaging said fastener.

22. An armrest construction for a chair, comprising:

an elongated support post defining a longitudinal axis and including a hollow free end defining an armrest mount, said free end being deformed so as to define a plurality of peripherally spaced lobes and a plurality of peripherally spaced and outwardly opening channels, one of said channels being disposed between each adjacent pair of said lobes such that said channels and said lobes are disposed in an alternating manner with one another about the longitudinal axis, said free end having portions which define said channels along an exterior surface of said free end, said portions additionally defining respective inner surfaces disposed within an interior of said free end, each said inner surface being radially aligned with, and facing away from, one of said channels, said inner surfaces together defining an engagement opening within said free end and opening in an axial direction; and an armrest assembly including a support arm disposed to support the arm of chair occupant and a hub connected to said support arm and mounted to said armrest mount of said post, said hub defining an open socket having an inner end defined by an end wall of said hub, said end wall of said hub defining a seat in which said armrest mount is disposed, said seat having a plurality of peripherally spaced ribs and a plurality of peripherally spaced and inwardly opening grooves, one of said grooves being disposed between each adjacent pair of said ribs such that said grooves and said ribs are disposed in an alternating manner with one another about a central axis of said hub, said ribs and grooves having shapes which conform and mate with respective ones of said channels and said lobes of said armrest mount to non-rotatably fix said armrest mount within said hub, said armrest assembly further including a fastener projecting through said end wall and into said engagement opening of said armrest mount to fixedly secure and prevent removal of said support arm from said post.

23. The armrest construction according to claim 22, wherein each adjacent pair of said inner surfaces are spaced from one another by an open region disposed within and defining part of said interior of said free end, each said open region being radially aligned with, and defining an interior of, one of said lobes.

24. The armrest construction according to claim 22, wherein said fastener is fixedly and contactingly engaged with the respective said inner surfaces defining said engagement opening in said armrest mount.

* * * * *

UNITED STATES PATENT AND TRADEMARK OFFICE

CERTIFICATE OF CORRECTION

PATENT NO. : 8,132,860 B2
APPLICATION NO. : 12/925888
DATED : March 13, 2012
INVENTOR(S) : Tim Fookes et al.

It is certified that error appears in the above-identified patent and that said Letters Patent is hereby corrected as shown below:

Column 7, Claim 9, Line 42:
after "tube" insert --at--

Column 10, Claim 22, Line 6:
after "arm of" insert --a--

Signed and Sealed this
Ninth Day of October, 2012

David J. Kappos

David J. Kappos
*Director of the United States Patent and Trademark Office*